US006095048A

United States Patent [19]

Ellis

[11] Patent Number: 6,095,048

[45] **Date of Patent: *Aug. 1, 2000**

[54] LITHOGRAPHIC IMAGING AND PLATE CLEANING USING SINGLE-FLUID INK SYSTEMS

[75] Inventor: Ernest W. Ellis, Harvard, Mass.

[73] Assignee: Presstek, Inc., Hudson, N.H.

[ * ] Notice: This patent is subject to a terminal disclaimer.

[21] Appl. No.: 09/151,921

[22] Filed: Sep. 11, 1998

[51] Int. Cl.[7] ..... B41N 3/00

[52] U.S. Cl. ..... 101/452; 101/450.1; 101/457; 101/462

[58] Field of Search ..... 101/450.1, 451, 101/452, 457, 461, 462, 463.1; 430/302

[56] References Cited

U.S. PATENT DOCUMENTS

| | | | |
|---|---|---|---|
| Re. 35,512 | 5/1997 | Nowak et al. | 101/454 |
| 4,162,920 | 7/1979 | Gillich | 101/465 |
| 5,061,607 | 10/1991 | Walls | 101/465 |
| 5,339,737 | 8/1994 | Lewis et al. | 101/453 |
| 5,354,633 | 10/1994 | Lewis et al. | 430/5 |
| 5,506,090 | 4/1996 | Gardner, Jr. et al. | 430/302 |
| 5,607,816 | 3/1997 | Fitzgerald et al. | 101/451 |
| 5,677,110 | 10/1997 | Chia et al. | 430/302 |
| 5,783,364 | 7/1998 | Ellis et al. | 101/467 |
| 5,786,129 | 7/1998 | Ellis | 101/454 |
| 5,807,658 | 9/1998 | Ellis et al. | 430/302 |
| 5,870,955 | 2/1999 | Williams et al. | 101/460 |

*Primary Examiner*—Stephen R. Funk
*Attorney, Agent, or Firm*—Cesari and McKenna, LLP

[57] ABSTRACT

Lithographic printing members have protective layers formulated specifically for use with single-fluid inks, and which are removed from the printing member during the preparatory procedures that precede printing. The protective layer provides protection against handling and environmental damage, and also extends plate shelf life; performs a cleaning function, entraining debris and carrying it away as the layer itself is removed; acts as a debris-management barrier if the layer immediately beneath the protective layer is ablated during the imaging process, preventing the emergence of airborne debris that might interfere with unimaged areas and/or imaging optics; and exhibits hydrophilicity, actually accelerating plate roll-up.

11 Claims, 1 Drawing Sheet

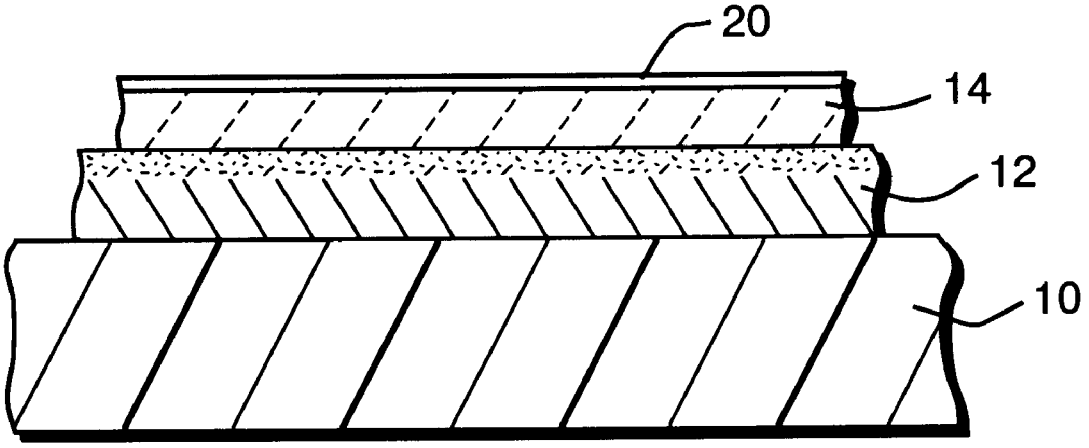
20
14
12
10

LITHOGRAPHIC IMAGING AND PLATE CLEANING USING SINGLE-FLUID INK SYSTEMS

BACKGROUND OF THE INVENTION

1. Field of the Invention

The present invention relates to digital printing apparatus and methods, and more particularly to imaging of lithographic printing-plate constructions on- or off-press using digitally controlled laser output.

2. Description of the Related Art

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The fountain solution prevents ink from adhering to the non-image areas, but does not affect the oleophilic character of the image areas.

An alternative to traditional wet printing is single-fluid ink systems, which are emulsions of an oleophilic ink phase and an aqueous or nonaqueous polar phase. The ink is applied directly to a wet plate without prior application of dampening fluid. The polar phase wets non-image, hydrophilic portions of the plate surface, forming a weak boundary layer that prevents adsorption of the oleophilic ink component. The ink component does, however, adsorb onto the oleophilic image portions of the plate. Typically, single-fluid inks are "water-in-oil" emulsions containing up to 80% of a hydrophilic liquid such as water or a polyhydric alcohol (e.g., ethylene glycol).

Photographic platemaking processes tend to be time-consuming and require facilities and equipment adequate to support the necessary chemistry. To circumvent these shortcomings, practitioners have developed a number of electronic alternatives to plate imaging. With these systems, digitally controlled devices alter the ink-receptivity of blank plates in a pattern representative of the image to be printed. U.S. Pat. Nos. 5,339,737 and 5,783,364, the entire disclosures of which are hereby incorporated by reference, to disclose a variety of lithographic plate configurations for use with imaging apparatus that operate by laser discharge. These include wet plates as described above and dry plates to which ink is applied directly. These plates may be imaged on a stand-alone platemaker or directly on-press.

In the former case, although the most cumbersome aspects of traditional platemaking are avoided, plates must be manually (and sequentially) loaded onto the platemaker, imaged, inspected, then transferred to the press and mounted to their respective plate cylinders. This involves a substantial amount of handling that can damage the plate, which is vulnerable—both before and after it is imaged—to damage from abrasion. Indeed, even fingerprints can interfere with plate performance by altering the affinity characteristics of the affected areas.

The ability to image on-press obviously reduces the possibility of handling damage substantially, but does not eliminate it. Plates must still be removed from their packaging and mounted to the press; in the case of ablation-type plates, it is frequently necessary to clean the plates to remove imaging debris, an operation that can result in abrasion if performed improperly. Indeed, lithographic printing plates can suffer damage even without handling: airborne debris, environmental contamination, movement of the packaged plates and the mere passage of time can inflict various stresses that interfere with ultimate plate performance.

To protect the plate during packaging, shipment and use, manufacturers may add a peelable barrier sheet to the final construction. As discussed, for example, in the '737 patent, this layer adheres to the surface of the plate, protecting it against damage and environmental exposure, and may be removed following imaging. But this sheet can itself damage the plate if the degree of adhesion is inappropriate or if carelessly removed, and in any case adds cost to the plate and its removal imposes an additional processing step.

U.S. Pat. No. 5,807,658 discloses wet lithographic printing plates that are provided with a protective layer serving a variety of beneficial functions, and which, desirably, washes away during the printing make-ready process. The protective layers disclosed in this application, however, are intended primarily for traditional wet printing using aqueous fountain solution.

DESCRIPTION OF THE INVENTION

Brief Summary of the Invention

The present invention provides protective layers formulated specifically for use with single-fluid inks, and which are removed from the printing member during the preparatory procedures that precede printing. The protective layer provides protection against handling and environmental damage, and also extends plate shelf life; performs a cleaning function, entraining debris and carrying it away as the layer itself is removed; acts as a debris-management barrier if the layer immediately beneath the protective layer is ablated during the imaging process, minimizing airborne debris that might interfere with unimaged areas and/or imaging optics; and exhibits hydrophilicity, actually accelerating plate "roll-up" —that is, the number of preliminary impressions necessary to achieve proper quality of the printed image. Because the protective layer of the present invention performs these functions but disappears in the course of the normal "make-ready" process that includes roll-up—indeed, even accelerates that process—its value to the printing process is substantial.

Accordingly, in a first aspect, the invention comprises an ablation-type wet printing member imageable by exposure to radiation and having a topmost layer removable by a single-fluid ink. In a second aspect, the invention pertains to a method of printing comprising the steps of providing an ablation-type wet printing member comprising a topmost layer removable by a single-fluid ink; creating a lithographic image on the printing member by selective exposure, in a pattern representing an image, to imaging radiation; and printing with the imaged member using a single-fluid ink, thereby removing the topmost layer.

It should be stressed that, as used herein, the term "plate" or "member" refers to any type of printing member or surface capable of recording an image defined by regions exhibiting differential affinities for ink and/or dampening fluid; suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is herein used in the printing sense to connote a surface affinity for a fluid which prevents ink from adhering thereto. Such fluids include water, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWING

The foregoing discussion will be understood more readily from the following detailed description of the invention, when taken in conjunction with the single FIGURE of the drawing, which depicts an enlarged sectional view of a recording construction in accordance with the present invention.

DETAILED DESCRIPTION OF THE PREFERRED EMBODIMENTS

Imaging apparatus suitable for use in conjunction with the present printing members includes at least one laser device that emits in the region of maximum plate responsiveness, i.e., whose lambda$_{max}$ closely approximates the wavelength region where the plate absorbs most strongly. Specifications for lasers that emit in the near-IR region are fully described in U.S. Pat. Nos. Re. 35,512 and 5,385,092 (the entire disclosure of which is hereby incorporated by reference); lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid plate movement (e.g., through use of high-speed motors) and thereby utilize high laser pulse rates, can frequently utilize a single laser as an imaging source.

With reference to FIG. 1, the depicted plate construction includes, in its most basic form, a substrate 10, a surface layer 12, and a protective layer 20. Substrate 10 is preferably strong, stable and flexible, and may be a polymer film, or a paper or thermally insulated metal sheet. Polyester films (in a preferred embodiment, the MYLAR film sold by E.I. duPont de Nemours Co., Wilmington, Del., or the MELINEX film sold by ICI Films) furnish useful examples. A preferred polyester-film thickness is 0.007 inch, but thinner and thicker versions can be used effectively.

Paper substrates are typically "saturated" with polymerics to impart water resistance, dimensional stability and strength. Aluminum is a preferred metal substrate. Ideally, the aluminum is polished so as to reflect any imaging radiation penetrating any overlying layers. One can also employ, as an alternative to a metal reflective substrate 10, a layer containing a pigment that reflects imaging (e.g., IR) radiation. A material suitable for use as an IR-reflective substrate is the white 329 film supplied by ICI Films, Wilmington, Del., which utilizes IR-reflective barium sulfate as the white pigment. A preferred thickness is 0.007 inch, or 0.002 inch if the construction is laminated onto a metal support as described hereinbelow.

Because hard materials deposited on softer materials (e.g., polyesters) can be vulnerable to scratching and similar surface damage, it may be helpful to apply a layer harder than substrate 10 to the surface thereof. This hard layer can be a highly crosslinked polyacrylate, and a representative thickness range for such a layer is 1–2 $\mu$m.

Layer 12 is a very thin (50–500 Å, with 300 Å preferred for titanium) layer of a metal that may or may not develop a native oxide surface 12s upon exposure to air. This layer ablates in response to IR radiation, and an image is imposed onto the plate through patterned exposure to the output of one or more lasers (as disclosed, for example, in U.S. Pat. No. 5,385,092, the entire disclosure of which is hereby incorporated by reference). The metal or the oxide surface thereof exhibits hydrophilic properties that provide the basis for use of this construction as a lithographic printing plate. Imagewise removal, by ablation, of layers 12/12s exposes underlying layer 10, which is oleophilic; accordingly, while layers 12/12s accept fountain solution, layer 10 rejects fountain solution but accepts ink. Complete imagewise ablation of layer 12 is therefore important in order to avoid residual hydrophilic metal in an image feature.

The metal of layer 12 is at least one d-block (transition) metal, aluminum, indium or tin. In the case of a mixture, the metals are present as an alloy or an intermetallic. Again, the development, on more active metals, of an oxide layer can create surface morphologies that improve hydrophilicity. Such oxidation can occur on both metal surfaces, and may also, therefore, affect adhesion of layer 12 to substrate 10 (or other underlying layer). Substrate 10 can also be treated in various ways to improve adhesion to layer 12. For example, plasma treatment of a film surface with a working gas that includes oxygen (e.g., an argon/oxygen mix) results in the addition of oxygen to the film surface, improving adhesion by rendering that surface reactive with the metal(s) of layer 12. Oxygen is not, however, necessary to successful plasma treatment. Other suitable working gases include pure argon, pure nitrogen, and argon/nitrogen mixtures. See, e.g., Bernier et al., *ACS Symposium Series* 440, *Metallization of Polymers*, p. 147 (1990).

The plate may also be provided with a metallic inorganic layer 14 comprising a compound of at least one metal with at least one non-metal, or a mixture of such compounds. It is generally applied at a thickness of 100–5000 Å or greater; however, optimal thickness is determined primarily by durability concerns, and secondarily by economic considerations and convenience of application. The metal component of layer 14 may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component of layer 14 may be one or more of the p-block elements boron, carbon, nitrogen, oxygen and silicon. A metal/non-metal compound in accordance herewith may or may not have a definite stoichiometry, and may in some cases (e.g., Al—Si compounds) be an alloy. Preferred metal/non-metal combinations include ceramics such as TiN, TiON, $TiO_x$ (where $0.9 \leqq x \leqq 2.0$), TiAlN, TiAlCN, TiC and TiCN. In this case, the construction can include layer 12 to promote adhesion of layer 14, or may instead omit layer 12.

A protective layer 20 is deposited over layer 12 or, if provided, over metallic inorganic layer 14. Layer 20 is preferably applied at a minimal thickness consistent with its roles, i.e., providing protection against handling and environmental damage, extending plate shelf life by shielding the plate from airborne contaminants, and entraining debris produced by imaging. The thinner layer 20 can be made, the more quickly it will wash off during press make-ready, the shorter will be the roll-up time, and the less the layer will affect the imaging sensitivity of the plate. In preferred embodiments, layer 20 comprises a thin layer of polyvinyl alcohol.

The following examples provide working formulations suitable for coating onto metallic and/or metallic inorganic layers.

| Example | 1 | 2 | 3 | 4 | 5 | 6 | 7 | 8 | 9 | 10 |
|---|---|---|---|---|---|---|---|---|---|---|
| Component | Parts | | | | | | | | | |
| 5.6% Airvol 523 | 20 | 20 | — | — | — | — | — | — | — | — |
| 2% Airvol 502 | — | — | 45 | — | — | — | — | — | — | — |
| 5% Airvol 502 | — | — | — | 20 | 20 | 20 | — | — | — | — |
| 5% Airvol 203 | — | — | — | — | — | — | 20 | — | — | — |
| 5% Airvol 205 in 15% MeOH/Water | — | — | — | — | — | — | — | 20 | 20 | 20 |
| Isopropyl alcohol | 6 | 6 | 10 | 6 | — | — | — | — | — | — |
| Methyl Alcohol | — | — | — | — | 6 | 6 | 6 | — | — | — |
| MeOH/Water | — | — | — | — | — | — | — | 20 | 13.23 | — |
| Diethylene glycol | 0.1 | 0.1 | 0.1 | 0.1 | 0.1 | 0.1 | 0.1 | 0.1 | 0.1 | 0.1 |
| Water | 13.9 | 23 | — | 23 | 23 | 14 | 14 | — | — | — |
| Solids content (%) | 2.8 | 2.44 | 1.63 | 2 | 2 | 2.5 | 2.5 | ≈2.5 | ≈3 | ≈5 |

In the foregoing examples, all Airvol materials are partially hydrolyzed polyvinyl alcohols with viscosities ranging from 3.0–27 cps, and are supplied by Air Products and Chemicals, Allentown, Pa. The materials are mixed together and applied to layer 16 using a #4 rod and dried at 80° C. for about 3 min to a yield a final coating thickness of about 0.02–0.05 μm. It was found that the formulations of Examples 8–10 coated most evenly, but those of Examples 6–8 provided best performance in terms of avoiding background toning and washing off with the shortest make-ready (i.e., requiring the fewest sheets to be run through the press before printing can commence). In particular, the formulations of Examples 6–8 washed off in the course of runs of fewer than 50 sheets.

It will therefore be seen that the foregoing techniques provide a basis for improved lithographic printing and superior plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of printing comprising the steps of:

a. providing an ablation-type wet printing member comprising a topmost polyvinyl alcohol layer removable by a non-aqueous single-fluid ink;

b. creating a lithographic image on the printing member by selective exposure, in a pattern representing an image, to imaging radiation; and c. printing with the imaged member using a non-aqueous single-fluid ink, thereby removing the topmost layer.

2. The method of claim 1 wherein, in addition to the topmost layer, the printing member comprises an imaging layer that is ablated by imaging radiation and an ink-receptive layer that is not ablated by imaging radiation.

3. The method of claim 2 wherein the imaging layer is hydrophilic.

4. The method of claim 3 wherein the imaging layer is a metal.

5. The method of claim 4 wherein the metal comprises a native oxide coating.

6. The method of claim 3 wherein the imaging layer is a ceramic.

7. The method of claim 6 wherein the imaging layer is selected from the group consisting of TiN, TiC, TiCN, $TiO_x$, TION, TiAlN, and TiAlCN.

8. The method of claim 6 wherein the printing member further comprises a thin metal layer between the imaging layer and the ink-receptive layer, the thin metal layer ablating in response to imaging radiation.

9. The method of claim 8 wherein the thin metal layer comprises a native oxide coating.

10. The method of claim 2 wherein the ink-receptive layer is polyester.

11. The method of claim 2 wherein the ink-receptive layer comprises a material that reflects imaging radiation.

* * * * *